US006546605B1

(12) United States Patent
Emery et al.

(10) Patent No.: US 6,546,605 B1
(45) Date of Patent: Apr. 15, 2003

(54) NAPPED FABRIC AND PROCESS

(75) Inventors: Nathan B. Emery, Spartanburg, SC (US); Franklin S. Love, III, Columbus, NC (US); Mathias B. Richardson, Pendleton, SC (US); Joseph E. Rumler, Chesnee, SC (US); Karen H. Stavrakas, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/344,596

(22) Filed: Jul. 10, 2001

(51) Int. Cl.[7] ..... D06C 11/00

(52) U.S. Cl. ..... 28/167; 28/104; 28/163; 26/29 R

(58) Field of Search ..... 28/104, 105, 106, 28/162, 163, 167; 26/29 R, 37, 30, 69 R

(56) References Cited

U.S. PATENT DOCUMENTS

| | | | | | |
|---|---|---|---|---|---|
| 2,338,792 | A | * | 1/1944 | Whitehead | 28/167 |
| 2,862,251 | A | | 12/1958 | Kalwaites | 19/161 |
| 3,033,721 | A | | 5/1962 | Kalwaites | 154/46 |
| 3,493,462 | A | | 2/1970 | Bunting, Jr. et al. | 161/169 |
| 3,508,308 | A | | 4/1970 | Bunting, Jr. et al. | 28/72.2 |
| 3,750,237 | A | | 8/1973 | Kalwaites | 19/161 |
| 3,768,121 | A | | 10/1973 | Kalwaites | 19/161 |
| 3,787,932 | A | | 1/1974 | Kalwaites | 19/161 |
| 3,800,364 | A | | 4/1974 | Kalwaites | 19/161 |
| 3,837,046 | A | | 9/1974 | Kalwaites | 19/161 |
| 3,873,255 | A | | 3/1975 | Kalwaites | 425/83 |
| 4,190,695 | A | | 2/1980 | Niederhauser | 428/234 |
| 4,329,763 | A | * | 5/1982 | Alexander et al. | 28/104 |
| 4,499,637 | A | * | 2/1985 | Greenway | 28/163 |
| 4,828,174 | A | | 5/1989 | Love, III | 239/11 |
| 4,967,456 | A | | 11/1990 | Stemlieb et al. | 28/104 |
| 5,080,952 | A | * | 1/1992 | Willbanks | 26/29 R |
| 5,136,761 | A | * | 8/1992 | Sternlieb et al. | 28/104 |
| 5,202,077 | A | * | 4/1993 | Marco et al. | 28/167 |
| 5,235,733 | A | | 8/1993 | Willbanks et al. | 28/105 |
| 5,337,460 | A | * | 8/1994 | Cockfield et al. | 28/167 |
| 5,475,905 | A | | 12/1995 | Cockfield et al. | 28/163 |
| 5,632,072 | A | * | 5/1997 | Simon et al. | 28/163 |
| 5,657,520 | A | | 8/1997 | Greenway et al. | 26/51 |
| 5,718,022 | A | | 2/1998 | Vuillaume | 28/105 |
| 5,768,756 | A | | 6/1998 | Noelle | 28/104 |
| 5,789,328 | A | * | 8/1998 | Kurihara et al. | 28/104 |
| 5,791,028 | A | | 8/1998 | Zolin | 26/1 |
| 5,870,807 | A | * | 2/1999 | Beaty et al. | 28/105 |
| 6,253,429 | B1 | * | 7/2001 | Zolin | 28/104 |
| 6,295,706 | B1 | * | 10/2001 | Strahm | 28/167 |
| 6,306,234 | B1 | * | 10/2001 | Barker et al. | 28/104 |

* cited by examiner

*Primary Examiner*—Amy B. Vanatta
(74) *Attorney, Agent, or Firm*—Terry T. Moyer; George M. Fisher

(57) ABSTRACT

A fabric having at least one hydraulically napped surface comprised of tangled fibers is disclosed. Because the fiber tangles are created from intact, undamaged fibers, fabric strength is not adversely affected by treatment. In addition, laundering enhances entanglement and the aesthetic qualities attributed to this fabric property: surface texture (hand), resistance to pilling, drapeability, and the like. These subjective characteristics have been quantified using values from the Kawabata Evaluation System. A process for creating such fabrics has also been disclosed. The fabric passes through one or two treatment zones in which high pressure fluids (e.g., water) are directed at the fabric surface as the fabric moves away from a support member. In the case of dual treatment zones, a substantially lower pressure is used in the second treatment zone.

7 Claims, 14 Drawing Sheets

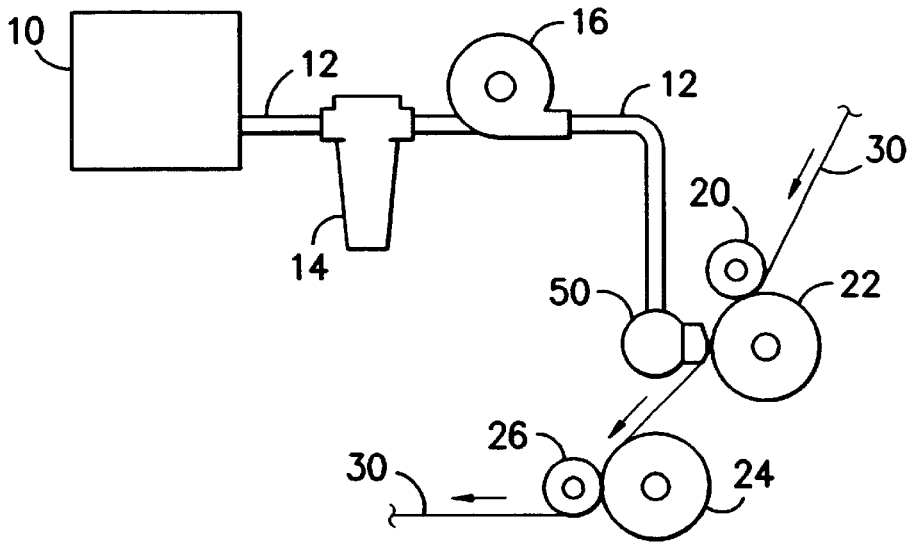
FIG. —1—
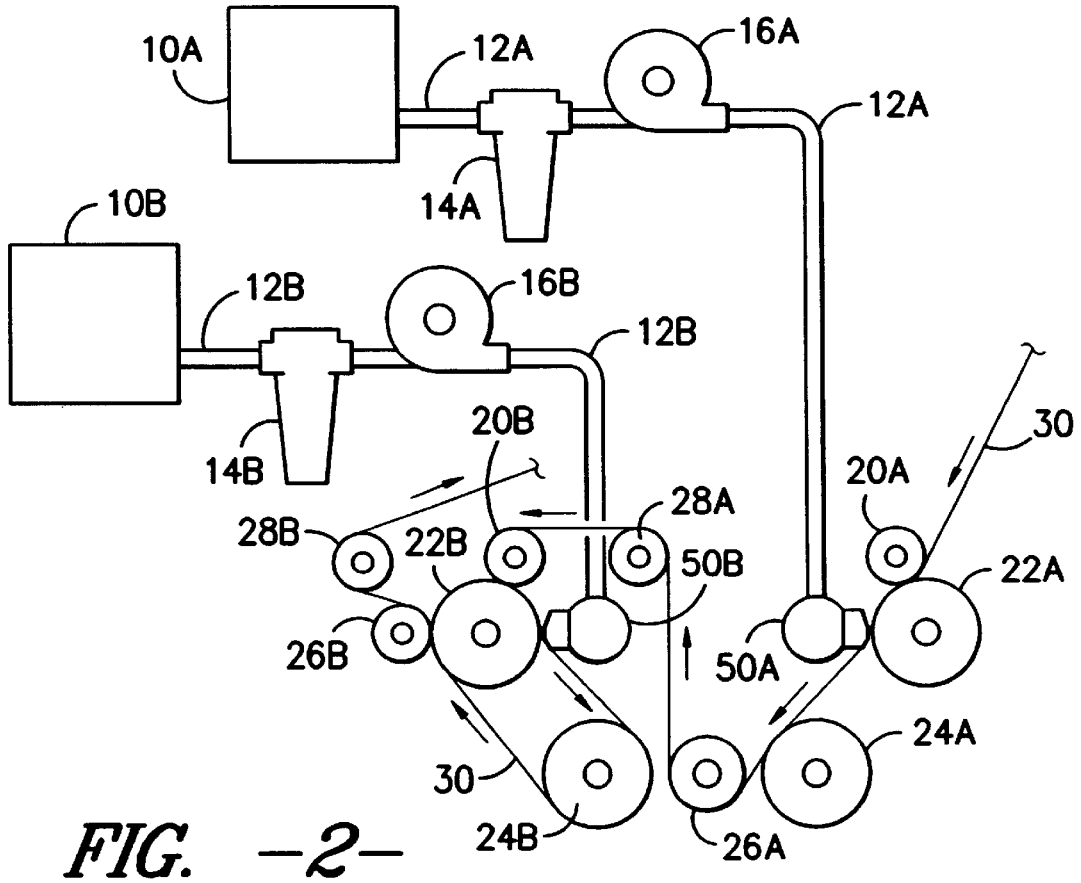
FIG. —2—

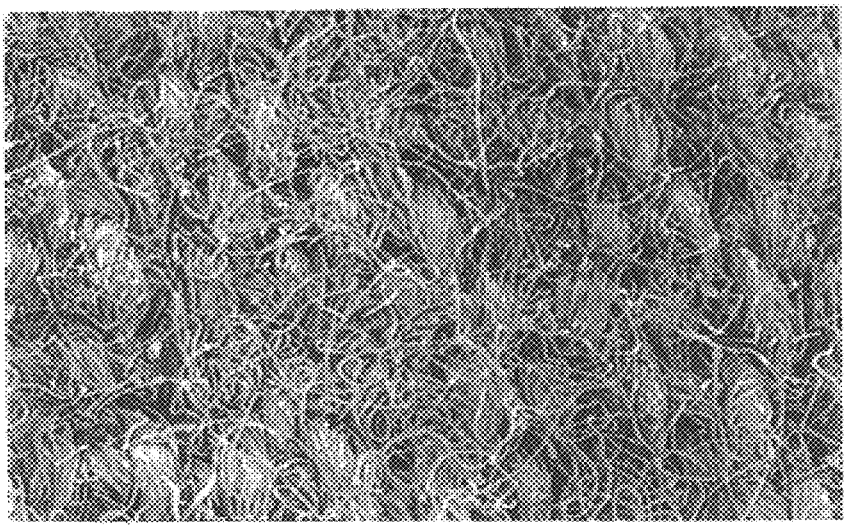
FIG. —9C—
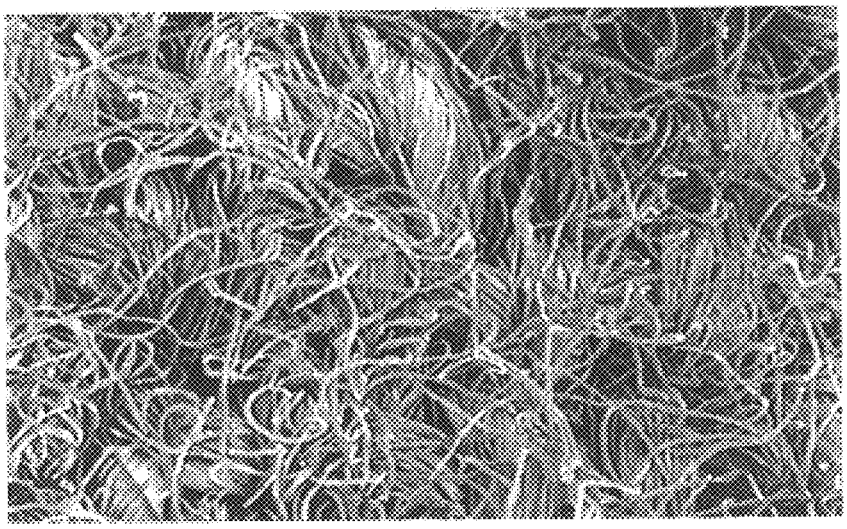
FIG. —9D—

CO-OCCURRENCE ANALYSIS

SUBJECT FABRIC

CO-OCCURRENCE ANALYSIS
FIRST COMPETITIVE FABRIC

CO-OCCURRENCE ANALYSIS

SECOND COMPETITIVE FABRIC

NAPPED FABRIC AND PROCESS

FIELD OF THE INVENTION

This invention relates generally to fabrics that have been napped to yield physical and aesthetic properties that were previously unavailable. More particularly, in a preferred embodiment, this invention relates to woven fabrics of specific constructions that have been hydraulically napped in accordance with the teachings herein. Such fabrics exhibit many highly desirable characteristics, such as relatively high strength, an exceptionally soft and compliant hand, and other qualities that make such fabrics particularly well suited to use in a variety of applications, including use as napery fabrics, with the additional important benefit that such qualities remain, and in some cases are significantly enhanced, after multiple washings.

BACKGROUND OF THE INVENTION

Practical methods for increasing the utility or desirability of textile fabrics are constantly sought by the textile industry. Of particular interest are fabrics and processes that are developed for end uses that share a common set of physical or aesthetic requirements. Through the use of creative fabric constructions and fabric processing techniques, fabrics that are especially well suited to specific end uses can be developed.

For example, the use of fabrics made from cotton or linen in napery (tablecloths, napkins, and the like) and related culinary or restaurant applications (aprons, etc.) is well known—the combination of hand, absorbency, drape, and other characteristics made these natural fiber fabrics the traditional fabrics of choice. In recent years, however, fabrics made from synthetic fibers, with their durability, dimensional stability (resistance to wash shrinkage) and resistance to shade changes (due to staining or fading from repeated laundering), have developed a strong following in the marketplace. These new fabrics, however, have not always shown clear superiority in several performance areas that are of fundamental importance, such as hand, drape, resistance to pilling and snagging, and wicking (moisture transport). While such fabrics can be made soft and relatively pleasant to the touch, the necessary conventional processing usually involves mechanical napping or sanding processes that tend to cut or damage fibers and thereby degrade the structural integrity of the fabric yarns and, ultimately, the overall strength and durability of the fabric. Furthermore, such processes can decrease moisture absorption and increase the likelihood of snagging and pilling. Fabric constructions or finishing processes that can impart superior drape and a soft, long-lasting feel to fabrics containing synthetic fibers without these additional shortcomings have been long sought.

Among the fabric processing techniques of the prior art that have been used in an attempt to achieve this result is the use of pressurized streams of water or other fluids. For example, commonly assigned U.S. Pat. No. 5,080,952 to Willbanks, the disclosure of which is hereby incorporated by reference, discloses a process for use with a polyester or polyester/cotton woven fabric by which a nap is raised primarily from warp yarns, and to a lesser extent from the fill yarns, by means of a hydraulic napping process in which discrete streams of high velocity water are directed onto the fabric as the fabric is held against a solid roll or other suitable support member.

Advantages of this, and perhaps other hydraulic napping processes of the prior art, as compared to conventional wire napping or sanding processes in which wires or abrasives are used to raise a nap or pile from the surface yarns, include the following: (1) the individual yarns comprising the fabric are not cut or otherwise damaged, but instead are merely rearranged (e.g., tangled) and extended from the plane of the fabric; (2) because of the lack of yarn damage, the strength of the fabric is not significantly impaired; (3) the nap raised tends to be uniform in height and density on the fabric side facing the roll; (4) because no shearing operation is needed, as would routinely be used for conventionally napped fabrics, fabric weight (per unit area) is preserved and other properties such as cover (i.e., relative light opacity) and absorbency can be enhanced as compared with fabrics that require a shearing step; and (5) limited nap raising occurs on the opposite side of the fabric (that side facing the water streams), although not to the same extent as occurs on the side facing the roll, thereby imparting a napping effect to both sides of the fabric at the same time, even though the streams impact one side only.

It has been found that, in spite of these advantages over conventional napping processes, these hydraulic processes of the prior art can affect the fabric in ways that are difficult to predict, resulting in non-uniform treatment and other processing shortcomings.

When the specific hydraulic napping process as described herein is used in conjunction with a specifically engineered fabric, also as described herein, the result is a fabric that displays a variety of desirable characteristics including high strength, high wash durability, color fastness, a soft and pliant hand with excellent subjective "feel", superior wicking, and high resistance to pilling and snagging. It is believed that hydraulically napped fabrics possessing this unique combination of properties may be particularly desirable in many textile market areas, including, but not limited to, indoor and outdoor apparel, home furnishings (including shades and draperies, bed and table linens, upholstery fabrics, and toweling), and their commercial hospitality counterparts. One specific application in the commercial hospitality area to which fabrics of this invention have been found to be particularly well suited is that of commercial napery. However, because of the high degree of superiority shown by the fabrics of this invention in a variety of important fabric performance parameters, it is contemplated that other market areas may also benefit from fabrics of the instant invention, even if one or more of the specific advantages listed above are not of paramount importance in those markets.

DESCRIPTION OF THE DRAWINGS

The foregoing advantages of this invention, as well as others, will be discussed further in the following detailed description of the invention, including the accompanying Figures, in which:

FIG. 1 is a schematic side view of an apparatus for practicing the instant invention, wherein a continuous web of fabric is treated on a single side of the web by an array of liquid jets;

FIG. 2 is a schematic side view of an apparatus for practicing the instant invention, wherein a continuous web of fabric is treated on both sides of the web by an array of liquid jets;

FIGS. 9C and 9D are scanning electron photomicrographs (normal orientation, 27× and 50×, respectively) of the surface of the fabrics of FIGS. 9A and 9B following treatment in accordance with the teachings herein and a single wash.

DETAILED DESCRIPTION

Figure 3:
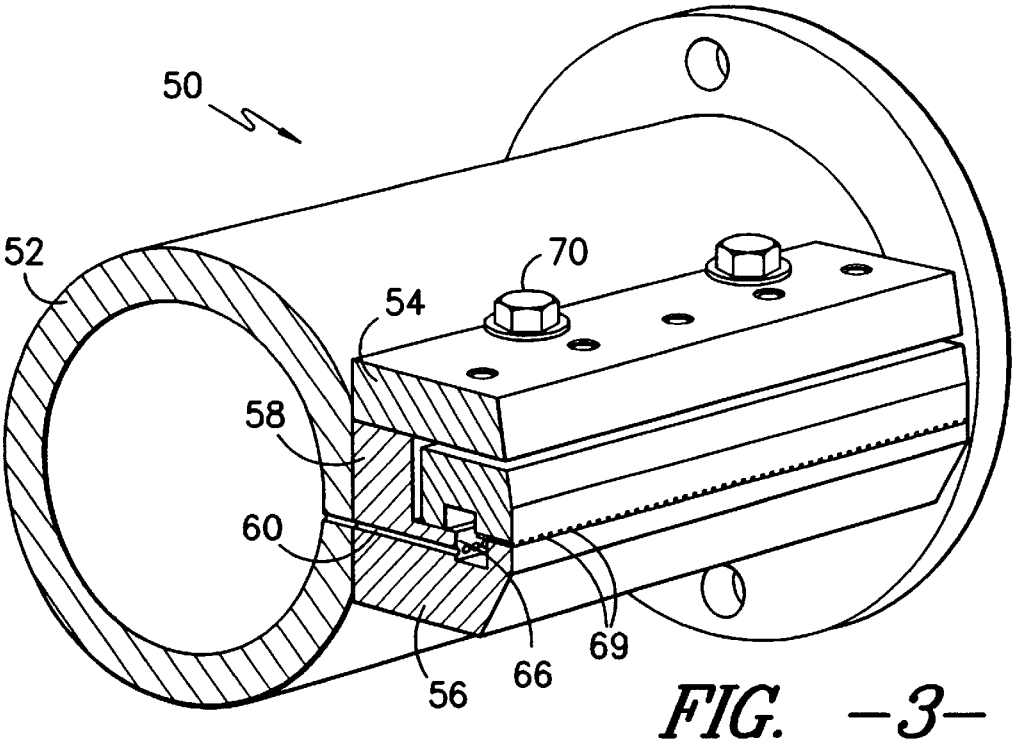
FIG. 3 is a perspective view of the high pressure manifold assembly depicted in FIGS. 1 and 2.

In the detailed discussion that follows, the following terms shall have the indicated meanings. The term "synthetic fiber" shall mean a man-made fiber, including, but not limited to, polyester, nylon, rayon, and acetate. The term "fiber loop" is intended to mean a segment of an individual fiber that is spaced apart from, but remains attached at both ends to, its associated yarn. The term "fiber tangle" is intended to mean a disordered arrangement of individual fiber loops, positioned above the surface of the fabric, that are associated with and connected to, but that are spaced apart from, a fiber bundle. A fiber tangle implies an arrangement in which the fiber loops are non-aligned and irregularly configured, but not necessarily entwined, interlocked or loosely knotted. A fiber tangle is primarily comprised of fiber loops, but may include free ends of fiber. The term "tangle cover" is intended to mean the extent to which the fiber tangle associated with a given surface yarn obscures from view the underlying fabric surface. The terms "napped" or "napping" as applied to fabric shall mean the raising of fibers from one or more surface yarns to form a plurality of fiber tangles that extend above the surface of the fabric and provide tangle cover. The term "surface yarn" is intended to mean that segment of a yarn comprising a fabric that forms a portion of the observed surface of the fabric, as viewed from a substantially normal (i.e., perpendicular to the plane of the fabric surface) perspective. The term "subsurface yarn" is intended to mean that segment of a yarn that is not a surface yarn (i.e., a subsurface yarn is hidden from view unless the fabric is reversed or seen in cross section). Using these definitions, a given warp or fill yarn in a woven fabric is considered to be comprised of a contiguous alternation of surface yarn segments and (where the yarn drops within or below the observed surface of the fabric) subsurface yarn segments. The term "observed surface fibers" is intended to mean those fibers comprising a surface yarn that are readily observable when viewed from a substantially normal (i.e., perpendicular to the plane of the fabric) perspective. The fabric side that faces the array of fluid streams shall be termed the array side of the fabric; the side that is nearest to the supporting surface shall be termed the support side of the fabric.

Turning now to the drawings, FIG. 1 shows generally an apparatus that can be used to produce the fabric of this invention wherein a moving web of fabric is treated on a single side only. Source 10 of the desired working fluid, which shall hereinafter be assumed to be water, but which may be another suitable fluid as may be required or desired under the circumstances, is connected to high pressure pump 16 by means of conduit 12. Use of a suitable filtering device 14 to remove particles and other undesirable matter from the water is recommended. From pump 16, the pressurized water is directed, via conduit 12, into stationary manifold assembly 50, to be described in more detail below, in which the water is formed into a plurality of discrete parallel streams that are directed onto the surface of the moving web of fabric 30 to be treated. Fabric web 30 moves along a path that takes it into the region immediately adjacent to the stream-generating side of manifold assembly 50 and into contact with a suitable support member, such as smooth steel roll 22, via roll 20. This region between the manifold and the support member through which the parallel streams of water are directed shall be referred to as the treatment zone.

Within the treatment zone, but immediately prior to being contacted by water streams from manifold assembly 50, fabric web 30 is directed away from roll 22, thereby providing a slight separation between the surface of support roll 22 and fabric web 30 as fabric web 30 is impacted by the streams from manifold assembly 50. Specifically, the path of fabric web 30 elevates it off the surface of steel roll 22 just prior to treatment by the individual water streams. In the preferred embodiment depicted in FIGS. 1 and 2, the "thread up" path of fabric web 30 describes a substantially straight line from a point of tangency, where fabric web 30 contacts support roll 22, at a location immediately upstream of the point of stream impingement, to the location downstream of the point of stream impingement where fabric web 30 is directed in front of manifold assembly 50, although some deflection may occur during operation at the point of stream impingement.

The significance of this separation between fabric web 30 and steel support roll 22 is in the role it plays in assisting in the efficient removal of water from the region within the treatment zone between fabric web 30 and the surface of support roll 22, which shall be referred to as the roll impact zone. Support roll 22 preferably is made to turn in the same direction that the fabric web is traveling within the treatment zone, and the entire manifold/roll assembly preferably is oriented so as to allow gravity to assist in the removal of water from the roll impact zone. This zone serves two important functions: it provides a means by which water buildup can be relieved, yet also provides a robust means of support for the fabric web 30 at the location of impact by the individual water streams. By providing these two seemingly contradictory functions, a high degree of uniformity in fabric web treatment can be achieved. It should be understood that while use of a steel roll as a support member has been described, a smooth solid plate or other means could be used, as desired.

It also frequently has been found advantageous to direct the individual streams of water at an angle that is slightly non-perpendicular, i.e., between about 1° and about 10° to the support roll surface, and in a generally downward direction (i.e., in the direction in which the spacing between the support roll and the moving fabric web is growing larger). In other words, as seen in FIG. 1, the plane containing the array of side-by-side individual streams emanating from manifold assembly 50 preferably does not contain the rotational axis of support roll 22. It is believed that this slight downward tilt to the water streams further minimizes the degree of water buildup between the fabric web and the roll, and further facilitates the removal of spent water from the roll impact zone. If left to accumulate within the treatment zone, such water buildup tends to interfere with the proper interaction between the impinging streams and the fabric surface.

Where a single treatment zone and relatively high stream pressures are used, angles between about 2° and about 8° are preferred, and angles between about 4° and about 6° are particularly preferred. If a second treatment zone is used, as is discussed in detail below, the water streams in the first treatment zone need not be inclined to the same extent—angles between about 1° and about 5° may be used—because the lower water pressure associated with the second treatment zone results in reduced water flow, and therefore less water buildup.

FIG. 2 shows the apparatus of FIG. 1 that has been adapted to treat both sides of a moving web of fabric web in a single pass. In FIG. 2, items corresponding to items in FIG. 1 carry similar identification or call-out numbers, with the letters "A" and "B" used merely to differentiate between that part of the apparatus used to treat one side of the fabric web (Side "A"), and the corresponding part used to treat the reverse side of the web (Side "B"). Water sources 10A and 10B supply water to separate high pressure pumps 16A, 16B via suitable filtering means 14A, 14B. Fabric web 30 moves into operative position in front of high pressure water jet manifolds 50A, 50B by means of various conventional roll means, as shown. Support members 22A, 22B are preferably rolls of steel or other suitable material having a smooth, solid surface. As discussed above, the point of water impingement coincides with that portion of the fabric web path during which the fabric web is in tangential relation to the surface of the support roll, i.e., the support roll is no longer contacting the fabric web, but rather is acting as a point from which fabric web 30 is held in moderate tension as web 30 is directed past water jet manifolds 50A, 50B and through the water jet streams.

FIG. 3 is a cutaway view of manifold assembly 50, which is used in the configurations of FIGS. 1 and 2, and shows the means by which an array of high pressure water streams may be formed and directed onto the moving web of fabric. High pressure water from the interior of manifold supply conduit 52 is directed through a plurality of passages 60 to reservoir gallery 66, formed from juxtaposed reservoir chambers 64 and 65 machined into chamber assembly 58 and gallery assembly 56, respectively (see FIG. 4). Cut into one of the mating surfaces of slotted chamber assembly 58 is a series of parallel slots or grooves 68 that, when chamber assembly 58 is mated to supply gallery assembly 56 by means of pressure bolts 70, form an array of parallel orifices 69, each having a substantially rectangular cross-section, from which an array of parallel streams of high pressure water can be directed on the moving web of fabric 30.

Figure 4:
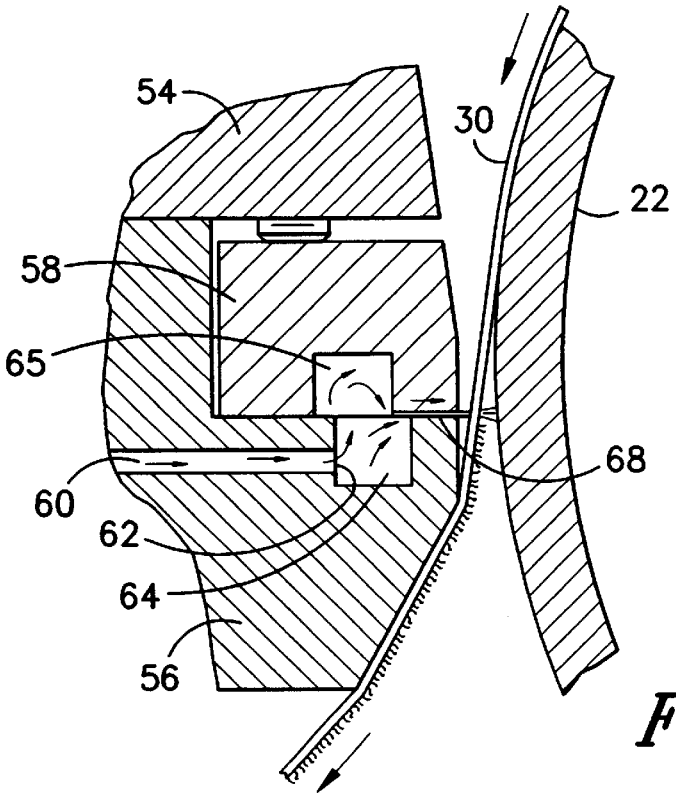
FIG. 4 is a cross-sectional view of the assembly of FIG. 3, showing the path of the high velocity fluid through the manifold, and the path of the substrate as it passes through the fluid stream being projected from the manifold assembly of FIG. 3.

FIG. 4 shows reservoir gallery 66 and related structures and their relation to moving fabric web 30. As indicated by the arrows, the working fluid passes through passages 60 in gallery assembly 56 into reservoir gallery 66 (FIG. 3) formed by reservoir chambers 64 and 65, which serves as a local distribution manifold for the orifices 69. As can be seen, fabric web 30 is guided, under tension, from support roll 22 (FIGS. 1 and 2) onto the lower forward portion of supply gallery assembly 56 to position web 30 tangential to and slightly separated from the surface of roll 22. This allows the water to pass through the fabric web without significant water buildup in the roll impact zone, and is believed to enhance the formation of a napped surface on the support side of the fabric web (i.e., the side facing the roll).

Figure 5A:
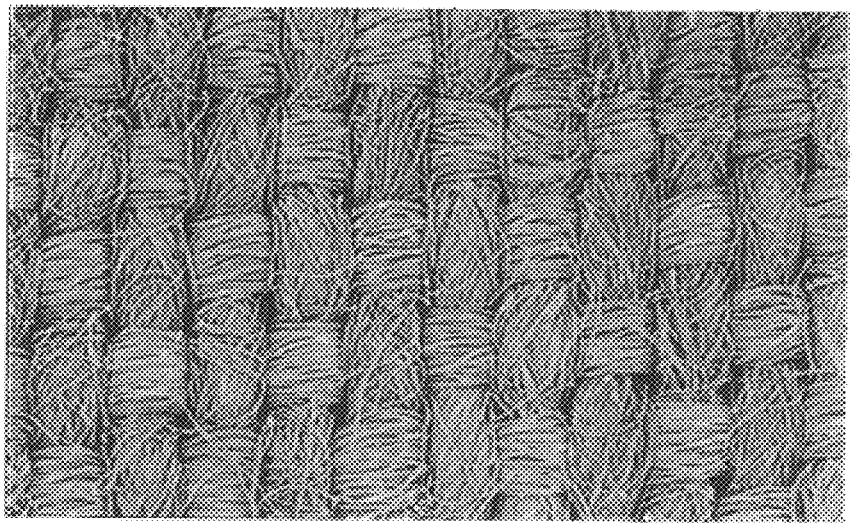
FIGS. 5A and 5B are scanning electron photomicrographs (normal orientation—i.e., perpendicular to the fabric plane, at 27× and 50×, respectively) of the surface of a fabric of this invention comprised of 100% synthetic fibers prior to treatment in accordance with the teachings herein.
Figure 5B:
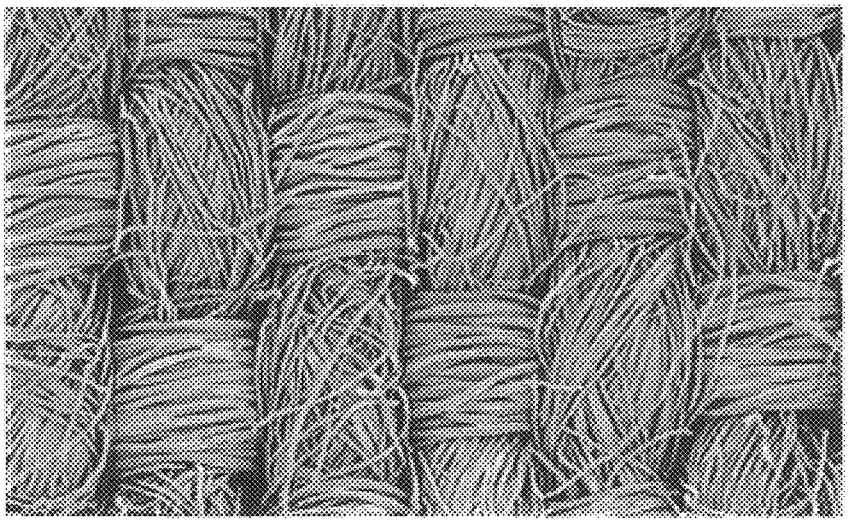

To treat a single side of fabric web, pump 16 delivers the water to manifold 50 at a pressure sufficient to generate a large number (perhaps several hundred or more) of discrete streams of water arranged in an array, each stream having a rectangular cross section ranging from about 0.010 in. ×0.015 in. to about 0.020 in.×0.025 in., with adjacent stream-to-stream spacing within the range of about 0.025 in. to about 0.050 in. The manifold exit pressures depend upon the fabric web being treated and the desired effect. Pressures ranging from about 200 p.s.i.g. to about 3000 p.s.i.g. are contemplated, with pressures between about 500 p.s.i.g. and about 2000 p.s.i.g. most commonly employed, and pressures between about 1000 p.s.i.g. and about 1600 p.s.i.g. being favored for a wide variety of fabric web styles of the kind disclosed herein. The distance between the roll surface and the manifold may range from about 0.030 in. to about 0.250 in., depending upon the nature of the fabric and the effect desired. Generally, roll-to-manifold distances of about 0.100 in. to about 0.200 in. are preferred. The fabric web is moved past manifold assembly 50 at a rate between about 10 yards per minute and about 80 yards per minute, and preferably between about 25 yards per minute and about 40 yards per minute, although speeds outside these ranges may be preferred with specific fabric webs and desired effects.

Where treatment on both sides of the fabric web is desired—a technique that has been found to generate a remarkably uniform layer of fiber tangles, in roughly equal amounts, on both sides of the fabric web—the web should pass through a second treatment zone wherein pressurized water streams are directed at the opposite side of the fabric web, substantially as described above. The manifold exit pressures associated with the second treatment zone, however, are preferably lower than the pressures associated with the first treatment zone. Specifically, second treatment zone manifold pressures of about 0.2 to about 0.8 times the pressures associated with the first treatment zone have been found effective, with values between about 0.3 and about 0.7 being preferred, and values between about 0.4 and about 0.6 being most preferred. Although these ratios may be modified somewhat if the water pressures in the first treatment zone are extreme, it has been found that where second treatment zone manifold pressures fall outside these ratios, the side-over-side (i.e., array side vs. support side) uniformity of the napped surface is significantly degraded. It is theorized that fiber tangles that are generated within the first treatment zone are partially redistributed through the fabric web within the second treatment zone, and relatively few additional fiber tangles are generated within the second treatment zone. Accordingly, second treatment zone pressures that are too low appear to distribute insufficient fibers to the reverse side, and second treatment zone pressures that are too high appear to distribute too many fibers to the reverse side. The various photomicrographs of FIGS. 5 through 9 show the surface of various fabric webs and graphically demonstrate the effects and advantages of the instant invention. As summarized in Table 1, FIGS. 5A, 5B show an untreated portion of the subject fabric of the invention. This fabric is subsequently treated and washed as described in Example 1 and the accompanying FIGS. 6A, 6B. FIGS. 7A, 7B and 8A, 8B show first and second fabrics, respectively, that are representative of currently available competitive napery fabrics, following one wash cycle as described in Examples 2 and 3. FIGS. 6Y, 6Z; FIGS. 7Y, 7Z and FIGS. 8Y, 8Z show, respectively, these same fabrics following 75 wash cycles, as described in the respective Examples 5 through 7 below. FIGS. 9A through 9D show the results of processing a blended fabric in accordance with the teachings herein.

EXAMPLE 1

The following example describes how a superior napery fabric is created using a combination of fabric construction techniques and high-pressure water treatment. This particular fabric is 100% polyester and is made of spun warp yarns and filament fill yarns. The fabric is constructed as a plain weave and has 55 ends per inch and 44 picks per inch in the greige state. The warp yarn is an open end spun 12/1 (i.e. a 12 singles cotton count yarn) with a twist multiple of 3.6, and the filament filling yarn is a 2/150/34 (i.e. 2 plies of 150 denier yarn, each ply containing 34 filaments) and is an inherently low-shrinkage filling yarn. The greige fabric without size weighs about 5.65 ounces per square yard. Prior to hydraulic processing, the fabric is shown in FIGS. 5A and 5B.

The above fabric is subjected to the following processing. One side of the fabric is subjected to high-pressure water at about 1400 p.s.i.g. (manifold exit pressure) The water originates from a linear series of nozzles which are rectangular (0.015 inches wide (filling direction)×0.010 inches high (warp direction)) in shape and are equally spaced along the treatment zone. There are 40 nozzles per inch along the width of the manifold. The fabric travels over a smooth stainless steel roll that is positioned 0.110 inches from the nozzles. The nozzles are directed downward about five degrees from perpendicular, and the water streams intersect the fabric path as the fabric is moving away from the surface of the roll. The tension in the fabric within the first treatment zone is set at about 35 pounds.

In the second treatment zone, the opposite side of the fabric is treated with high-pressure water that originates from a similar series of nozzles as described above. In this zone the water pressure is about 700 p.s.i.g., the gap between the nozzles and the treatment roll is 0.160 inches, and the nozzles are directed downward about three degrees from perpendicular. As before, the water streams intersect the fabric path as the fabric is moving away from the surface of the roll. The fabric tension between the treatment zones is set at about 60 pounds, and the fabric exit tension is set at about 60 pounds. Maintenance of these specific tension levels is preferred, but is not necessarily critical to achieve an acceptable result.

The fabric is dried and then subjected to a variety of finishing chemicals. It is pulled to the desired width in a tenter frame, and the finished weight is about 6.25 ounces per square yard. Fabrics having finished weights between about 5 ounces per square yard and about 9 ounces per square yard, and preferably between about 6 ounces per square yard and about 8 ounces per square yard, and most preferably between about 6 ounces per square yard and about 7 ounces per square yard, have been found to be particularly suitable in napery uses.

The fabric is then subjected to a single standard industrial wash, in accordance with the following procedure:

The fabric was loaded into an industrial washer (extractor Model 30015) manufactured by Pellorin Milner Corp., of Kenner, LA. The equipment was verified to be free of burrs and sharp edges, to have properly functioning water level, temperature controls, and chemical delivery systems.

SUGGESTED WASH FORMULAS & CHEMICAL SUPPLIES FOR MILLIKEN NAPERY

| CYCLE | WATER LEVEL | TEMPERATURE ° F. | TIME (Min.) | CHEMICALS/ 100 lbs. |
|---|---|---|---|---|
| Flush | High | 120 | 3 | |
| Break | Low | 160 | 12 | 24 oz. Alkali<br>30 oz. Surfactant |
| Carry-over | Low | 160 | 6 | |
| Rinse | High | 145 | 2 | |
| Rinse | High | 130 | 2 | |
| Rinse | High | 115 | 2 | |
| Sour | Low | 90–100 | 8 | 2 oz. Sour |
| Extract | | | 5 | |

The extraction time should be sufficient to permit the fabric to be ironed without tumble drying. The fabric was removed from the laundering unit and pressed (using a Model AE Air Edge Press, manufactured by New York Pressing Machinery Co. of New York, N.Y.) for a total press cycle time of 20 seconds, consisting of 5 seconds of steam, 10 seconds of bake (at 380° F.) and 5 seconds of vacuum.

The following wash chemicals were supplied by U.N.X. Incorporated of Greenville, N.C.:

Alkali—Super Flo Kon NP

Surfactant—Flo SOL

Sour—Flo NEW

Figure 6A:
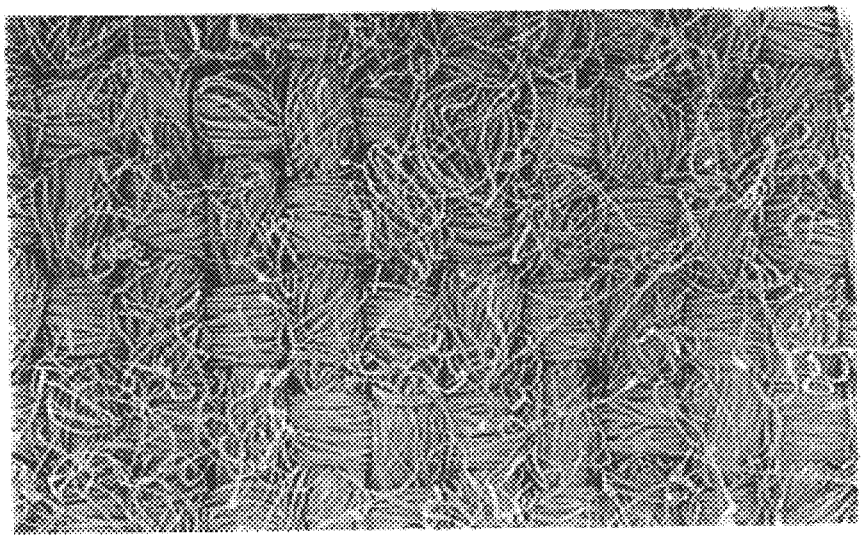
FIGS. 6A and 6B are scanning electron photomicrographs (normal orientation, 27× and 50×, respectively) of the surface of the fabric of FIGS. 5A and 5B following treatment in accordance with the teachings herein and a single wash.
Figure 6B:
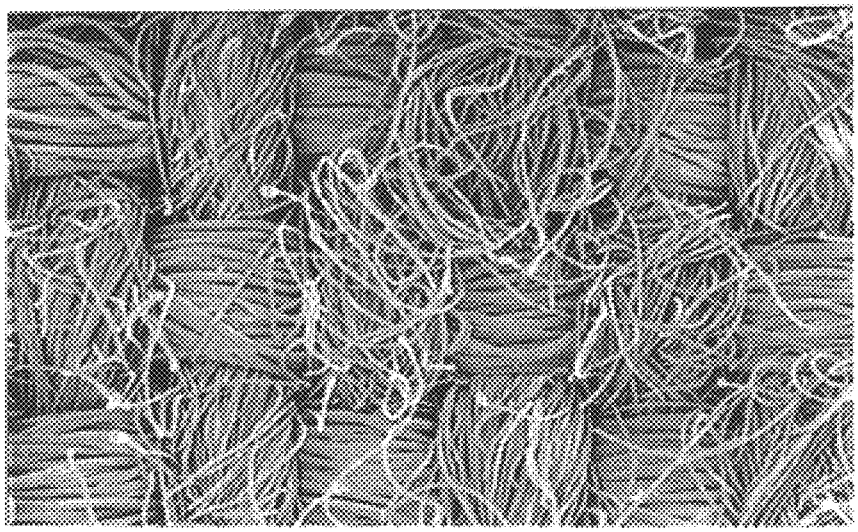
Figure 6Y:
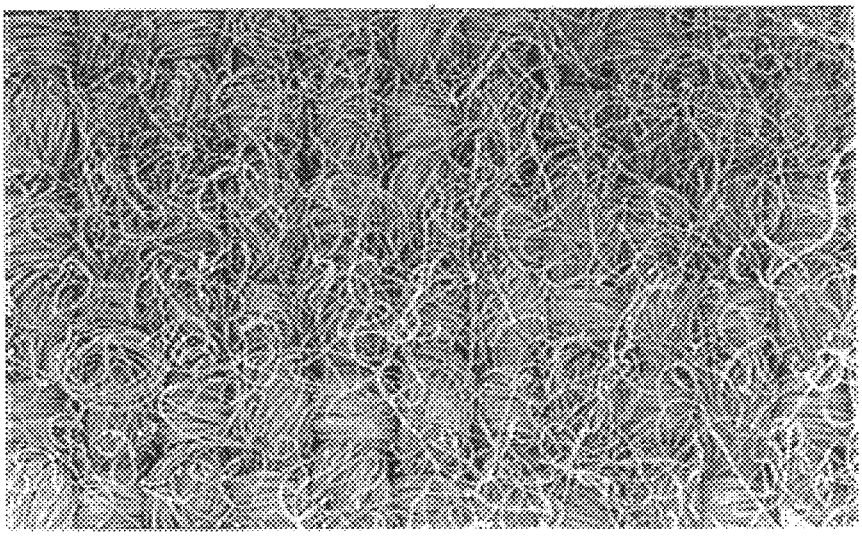
FIGS. 6Y and 6Z are scanning electron photomicrographs (normal orientation, 27× and 50×, respectively) of the surface of the treated fabric of FIGS. 6A and 6B, following 75 washes.
Figure 6Z:
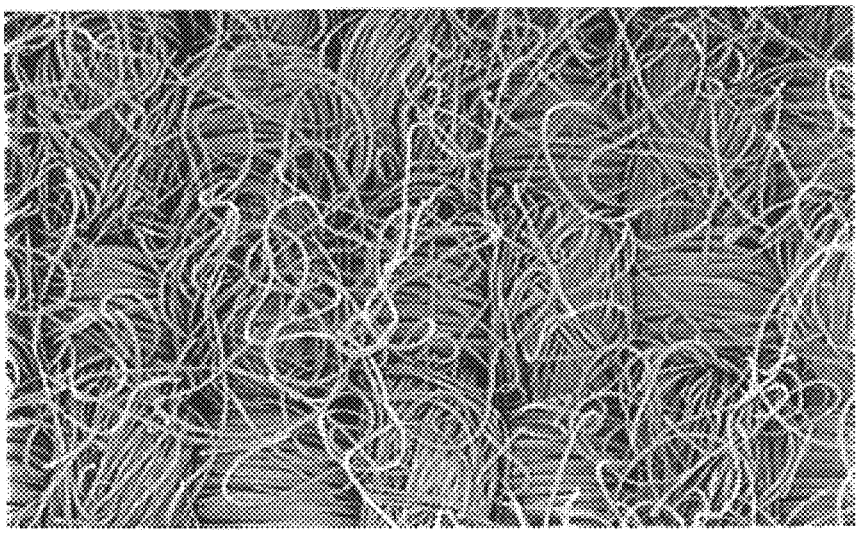

The results are as shown in FIGS. 6A and 6B and as described in Table 1. (Only one side of the fabric is shown; both sides of the fabric are substantially identical in terms of fiber entanglement, etc.) The fabric surface shows a plurality of fiber tangles, each comprised of fibers that are essentially intact and undamaged, i.e., the individual fibers show no nicks, dents, fibrillations, or other surface irregularities or deformities. The tangle cover is, in some cases, sufficiently dense so as to obscure from view the underlying fiber bundle to a significant degree.

EXAMPLE 2

A first competitive fabric is 100% polyester and has a spun warp and a spun filling. The fabric is constructed as a plain weave and has 63 ends per inch and 47 picks per inch in the finished state. The warp yarn is an air spun 151 made of type T 510 polyester fiber (1.2 denier per filament×1.5 inches in length), and the filling yarn is an air spun 151 made of type T 510 polyester (1.2 denier per filament×1.5 inches in length). The finished fabric weighs 5.8 ounces per square yard.

Figure 7A:
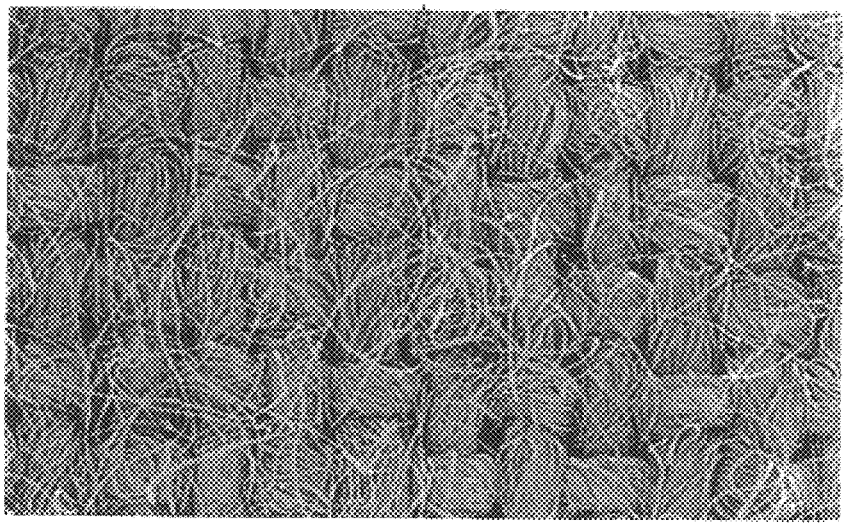
FIGS. 7A and 7B are scanning electron photomicrographs (normal orientation, 28× and 50×, respectively) of the surface of a first competing fabric, representing one embodiment of the prior art, following a single wash.
Figure 7B:
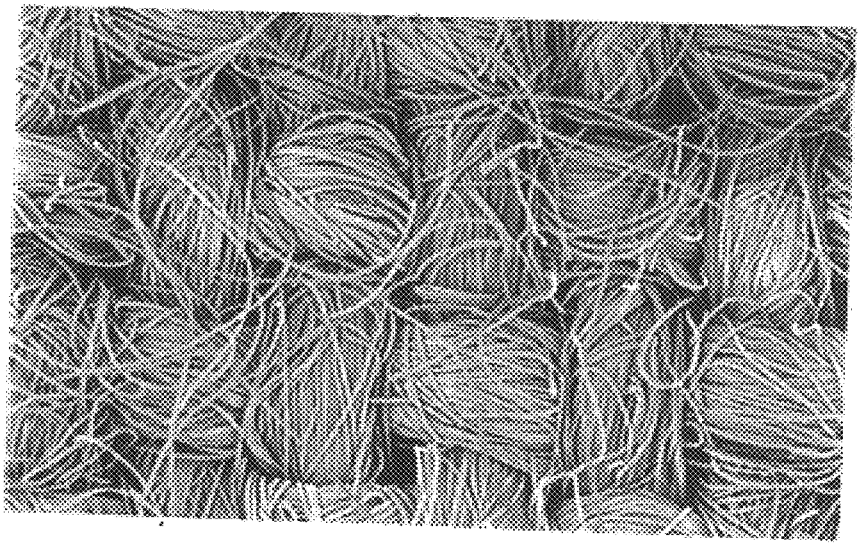

The fabric is subjected to a single standard industrial wash, in accordance with the wash procedure of Example 1. The result is as shown in FIGS. 7A and 7B and described in Table 1.

EXAMPLE 3

A second competitive fabric is 100% polyester and has a spun warp and a spun filling. The fabric is constructed as a plain weave and has 67 ends per inch and 44 picks per inch in the finished state. The warp yarn is an air spun 11/1 made of type T510 polyester fiber (1.2 denier per filament×1.5 inches in length), and the filling yarn is an air spun 12/1 made of type T510 polyester (1.2 denier per filament×1.5 inches in length). The finished fabric weighs 7.2 ounces per square yard.

Figure 8A:
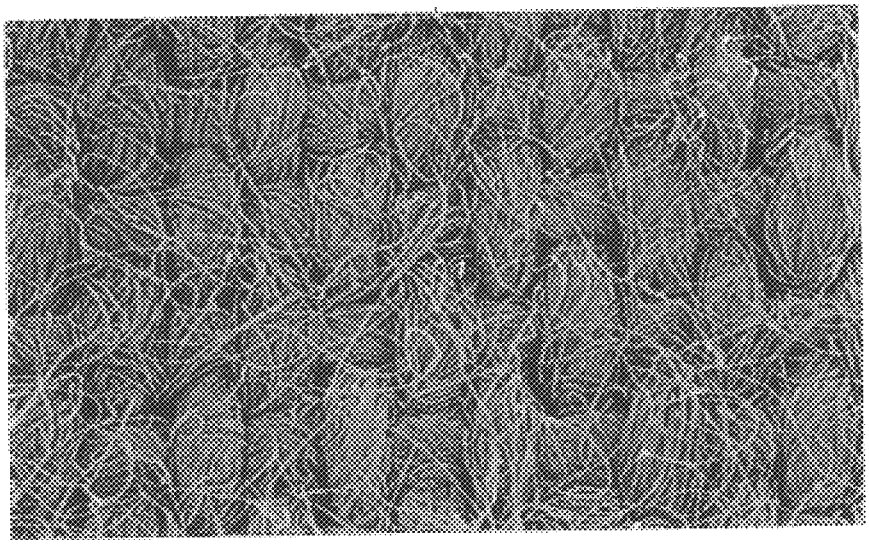
FIGS. 8A and 8B are scanning electron photomicrographs (normal orientation, 28× and 50×, respectively) of the surface of a second competing fabric, representing another embodiment of the prior art, following a single wash.
Figure 8B:
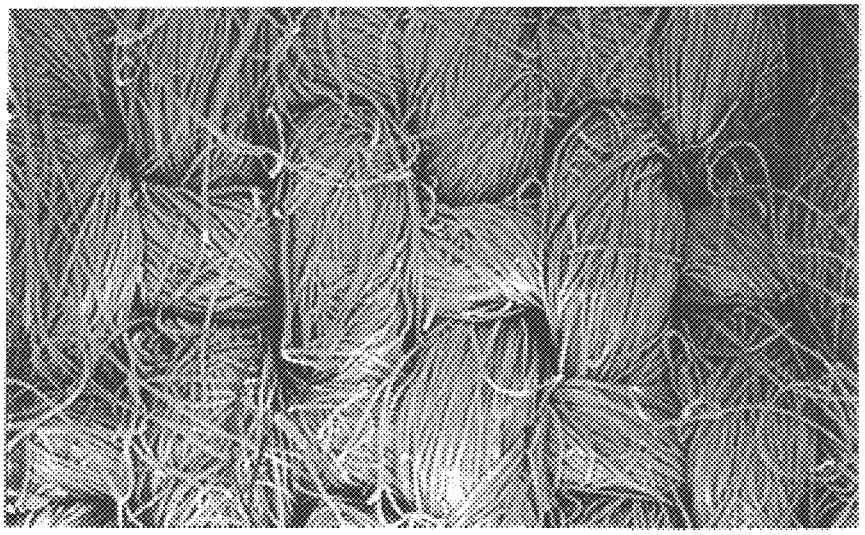

The fabric is subjected to a single standard industrial wash, in accordance with the wash procedure of Example 1. The result is as shown in FIGS. 8A and 8B and described in Table 1.

Although the Examples above have discussed only fabrics comprised exclusively of synthetic fibers, it is contemplated that treated fabrics comprised of blends of synthetic and natural fibers should be included as part of the instant invention. The following specific, non-limiting example involves the use of a polyester and cotton blend in the warp of a blended woven fabric, with either a blended or wholly synthetic fill yarn.

EXAMPLE 4

Figure 9A:
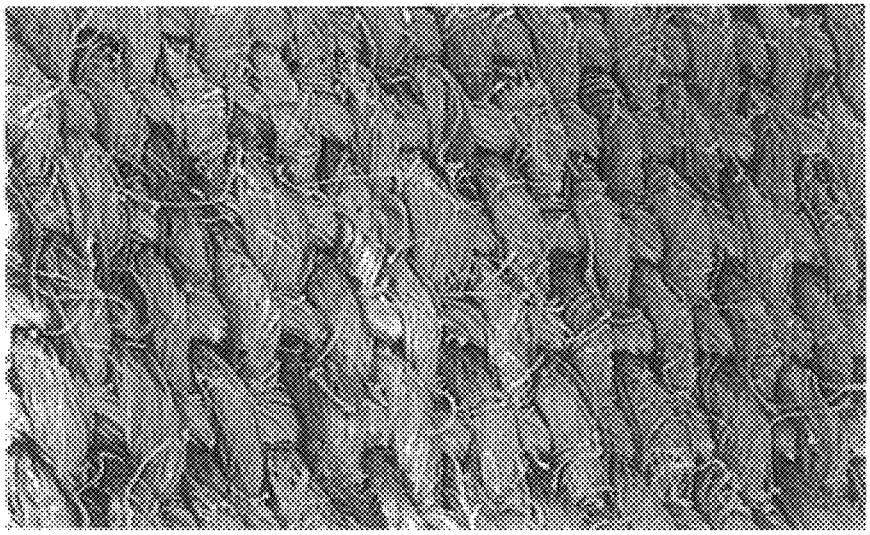
FIGS. 9A and 9B are scanning electron photomicrographs (normal orientation, 27× and 50×, respectively) of the surface of a fabric of this invention comprised of synthetic and natural fibers, prior to hydraulic napping in accordance with the teachings herein.
Figure 9B:
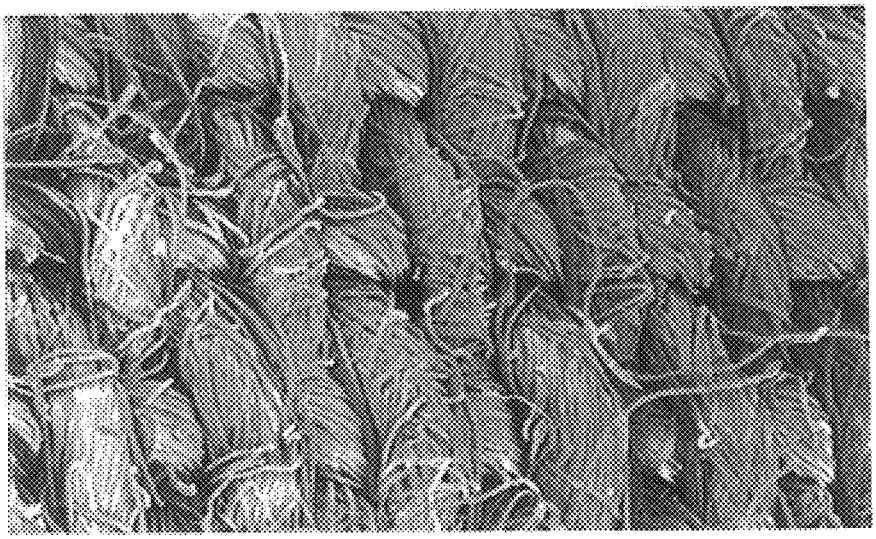

A blended fabric is comprised of a 65/35 blend of polyester and cotton made with a spun warp and a spun filling. The fabric is constructed as a plain weave and has 102 ends per inch and 53 picks per inch in the finished state. The warp yarn is an open end spun 26/1, 65/35 poly/cotton blend with a twist multiple of 3.69. The filling yarn is a ring spun 25/1, 65/35 poly/cotton blend with a twist multiple of 3.80. The finished fabric weighs 4.25 ounces per square yard. FIGS. 9A and 9B show the fabric surface prior to a hydraulic napping step as described below.

The fabric is hydraulically napped as set forth in Example 1, above, except that the water pressure within the first treatment zone is 1200 p.s.i.g., the spacing between the manifold and the support roll in the first treatment zone is 0.120 inches, the speed of the fabric web is 30 yards per minute, and the relative angle of the water jets is 0°.

The result is as shown in FIGS. 9C and 9D and described in Table 1. As can be seen, a profusion of fiber tangles has been created above the surface yarns that appear to be well distributed laterally, and the observed fiber tangles are not readily associated with warp yarns or fill yarns.

It is believed that the hydraulic napping action as described herein is most effective, but not exclusively so, when the target fabric contains yarns with staple fibers in significant quantities. The napping action is also most effective when those yarns are held within the target fabric structure in a way that allows the energy in the individual water streams to displace, without damage or complete removal, segments of the staple fibers, thereby forming a plurality of fiber tangles comprised of disordered, but undamaged, staple fiber segments that remain attached at both ends to their respective yarns or fiber bundles. Generally, this has been found to occur most reliably in woven fabrics where the staple fibers are contained in the warp yarns, or contained in both the warp and fill yarns.

An important characteristic and advantage of this invention is the relative durability, following repeated washings, of the napped surface that is formed. This is believed to be due to the number of fiber tangles that are generated initially, as well as the extent to which the fibers are disordered within the fiber tangles, and the effects that mechanical washing actions have on the fabric. This combination of characteristics is believed to form a robust nap structure that not only successfully resists the rigors of repeated launderings, but that tends to improve with such launderings—the degree of distributional uniformity (i.e. lateral cover) and degree of disorder of the observed fiber tangles both appear to increase dramatically as a result of repeated laundering, as compared with the nap surface immediately following the hydraulic napping operation.

As a means to gauge the extent of this characteristic and assess the magnitude of this advantage, the subject fabric of this invention as seen in FIGS. 6A, 6B and the commercially available competing napery fabrics of FIGS. 7A, 7B and 8A, 8B were each subjected to 75 standard launderings and then examined by photomicrography. The details and results of this comparison are the subject of Examples 5 through 7, below.

EXAMPLE 5

The fabric of Example 1 and shown in FIGS. 6A and 6B is washed (as described in Example 1) 75 times in succession. The surface of the fabric is as seen in FIGS. 6Y and 6Z, and as described in Table 1.

EXAMPLE 6

Figure 7Y:
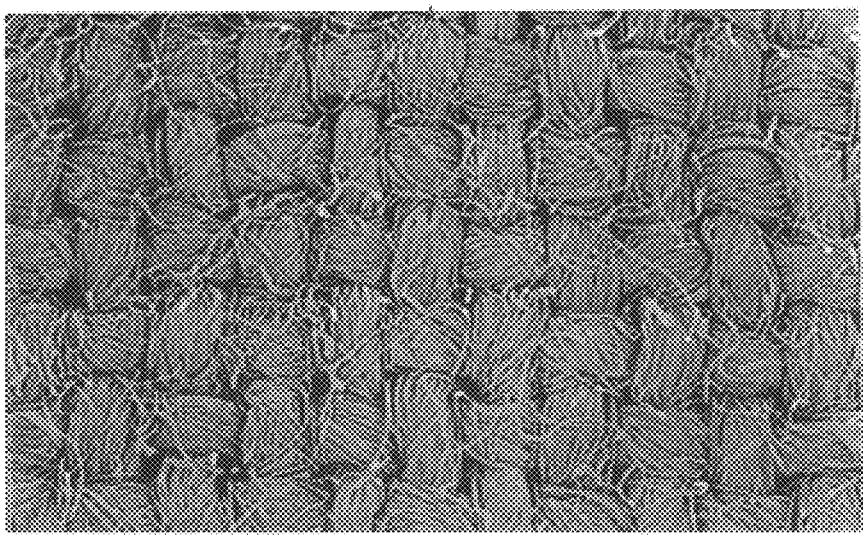
FIGS. 7Y and 7Z are scanning electron photomicrographs (normal orientation, 28× and 50×, respectively). of the surface of the fabric of FIGS. 7A and 7B, following 75 washes.
Figure 7Z:
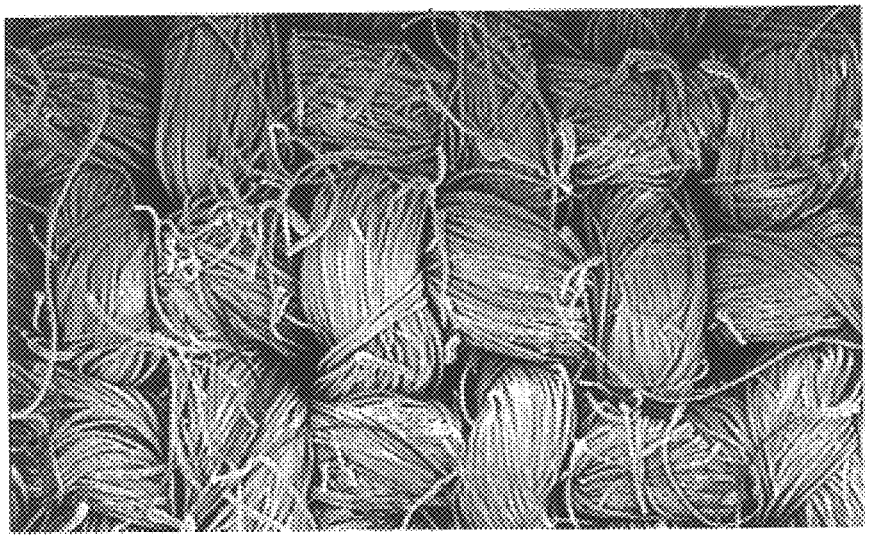

The fabric of Example 2 and shown in FIGS. 7A and 7B is washed (as described in Example 1) 75 times in succession. The surface of the fabric is as seen in FIGS. 7Y and 7Z, and as described in Table 1.

EXAMPLE 7

Figure 8Y:
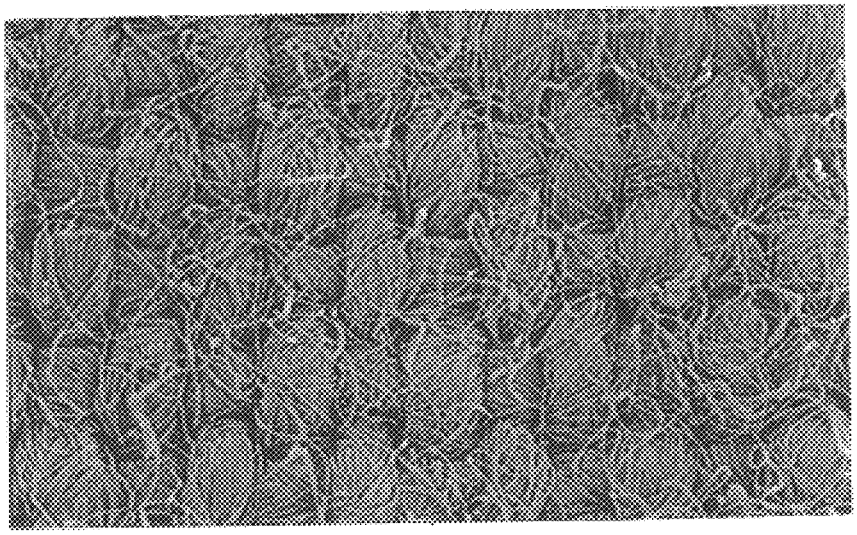
FIGS. 8Y and 8Z are scanning electron photomicrographs (normal orientation, 28× and 50×, respectively) of the surface of the fabric of FIGS. 8A and 8B, following 75 washes.
Figure 8Z:
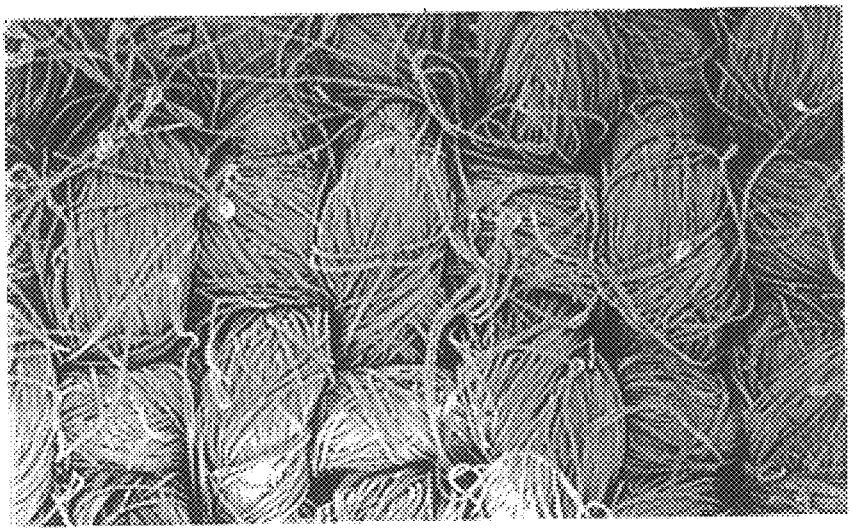

The fabric of Example 3 and shown in FIGS. 8A and 8B is washed (as described in Example 1) 75 times in succession. The surface of the fabric is as seen in FIGS. 8Y and 8Z, and as described in Table 1.

It should be noted that attempts to subject fabrics having a high cotton content typically do not survive 75 washes, due to degradation of the cotton fibers.

The following table summarizes some principal observations and comments based upon the above-referenced photomicrographs.

TABLE 1

(PHOTOMICROGRAPH SUMMARY)

| FIG. Nos. | Subject of Photomicrograph | Description | Comments |
|---|---|---|---|
| 5A, 5B | Untreated subject fabric; normal (perpendicular) view | Spun polyester warp is substantially confined to yarn bundle; filament fill is in orderly bundles | No fiber tangles outside yarn bundles |
| 6A, 6B | Treated subject fabric (1 wash); normal view | Many localized fiber tangles; distinct checkerboard pattern indicates primary involvement of warp yarns | Treatment has partially dislocated significant numbers of staple fibers from warp yarn bundles |
| 6Y, 6Z | Treated subject fabric (75 washes); normal view | Dramatically increased number of fiber tangles obliterating checkerboard effect | Multiple washings have enhanced treatment |
| 7A, 7B | First competitive fabric (1 wash); normal view | Little entanglement; no distinct checkerboarding | Fiber entanglements quite isolated compared with treated subject fabric |

TABLE 1-continued (PHOTOMICROGRAPH SUMMARY)

| FIG. Nos. | Subject of Photomicrograph | Description | Comments |
|---|---|---|---|
| 7Y, 7Z | First competitive fabric (75 washes); normal view | Yarn bundles appear more ordered; visible entangled fibers appear much more localized than after 1 wash | Multiple washings have compacted or removed fiber tangles |
| 8A, 8B | Second competitive fabric (1 wash); normal view | Limited fiber entanglement; no distinct checker-boarding | Fewer entangle-ments than subject fabric (FIG. 6A, 6B) |
| 8Y, 8Z | Second competitive fabric (75 washes); normal view | Slightly more entanglement than after 1st wash; no checkerboarding | Fiber entanglements somewhat compacted |
| 9A, 9B | Treated subject blended fabric prior to hydraulic napping; normal view | Nominal occurrence of fiber tangles and unattached fiber ends | Individual fiber tangles are sparse |
| 9C, 9D | Treated subject blended fabric following hydraulic napping | Widespread occurrence of fiber tangles, well distributed laterally; tangles not readily associated with specific warp or fill surface yarns | Treatment has partially dislocated significant numbers of staple fibers from surface yarn bundles |

In an effort to quantify some of the distinctions and advantages of the instant invention, a statistical technique generally referred to as "co-occurrence" analysis was performed, using the scanning electron microscope images of FIGS. 5A, 6A, 6Y, 7A, 7Y, 8A, and 8Y. These statistics are derived from a "co-occurrence matrix." The matrix is sometimes called a concurrence matrix or second order histogram (Jain 1989). The advantage of using this approach is the objective quantification of texture or degree of nap with a single number.

There is good correlation between the statistic referred to as "energy" in the References (see below) and the degree of nap. "Energy" is a general statistic for analyzing texture, and its value changes when the regularity of a texture changes. It is an unweighted average of the squares of fundamental co-occurrence matrix values, and is therefore not biased for any particular application. For convenience, this statistic shall be referred to as the "nap index" in FIGS. 10A through 10C.

The nap formed by the fiber tangles discussed herein covers up the regular weave structure of the fabric, thereby essentially randomizing the image. This leads to an decrease in the statistic, reflecting an increase in the degree of nap. The sign of the statistic was changed for convenience, so that an increase in the degree of nap results in an increase in the value of the nap index.

The statistic was calculated for each sample from four SEM images, formed by dividing the respective FIGS. 5A, 6A, 7A, and 8A each into quadrants, and treating each as a separate image. These repeat calculations provide a measure of statistical variation. This variation is used as an estimate of statistical confidence. A 90% confidence level (two standard deviations) was used for the range of variation of the four measurements for each sample. The two competitor samples did not include control samples (untreated fabric), and although all samples were plain weaves, the weave structures did not match exactly the control sample of the subject fabric. Therefore, it is not possible to make statistically meaningful comparisons among the various products.

Figure 10A:
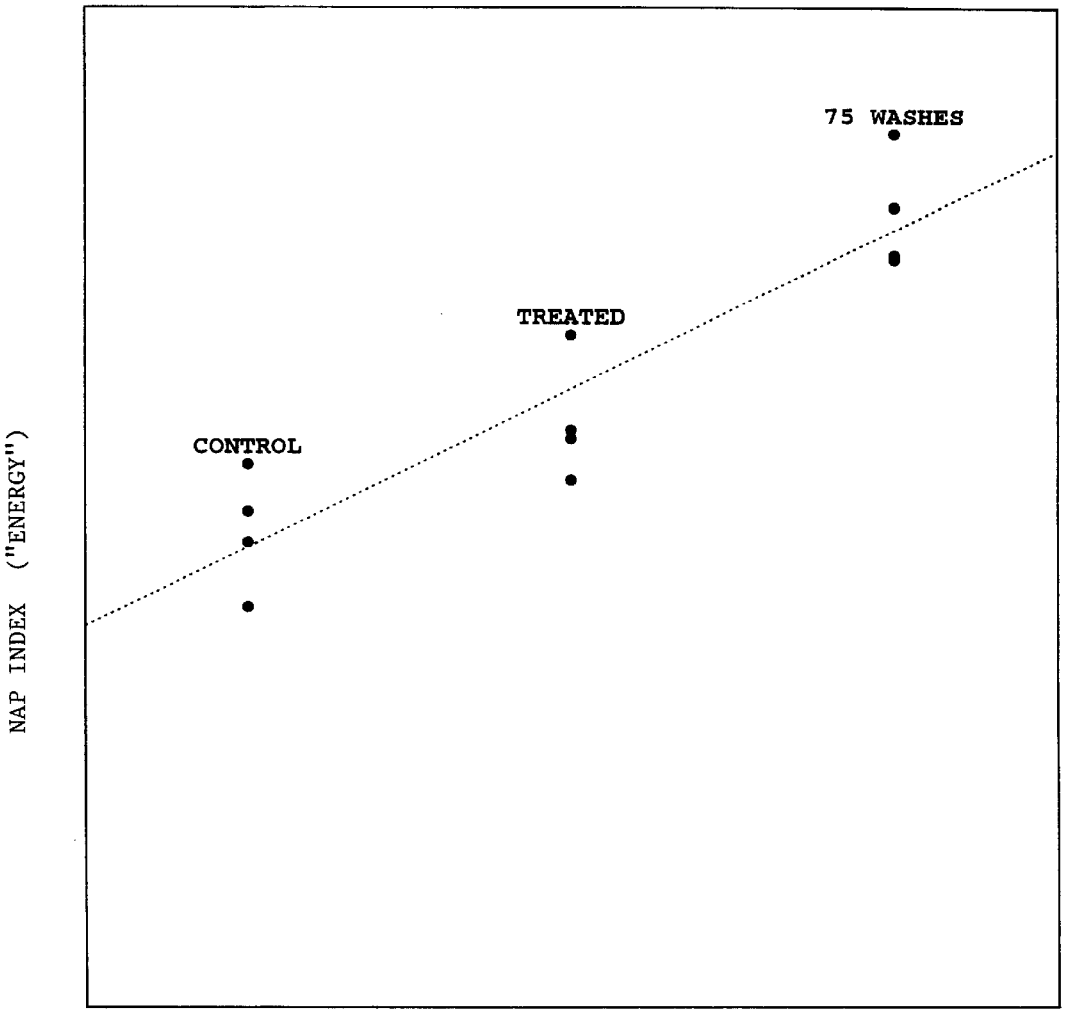
FIGS. 10A through 10C are graphs representing the results of a "co-occurrence" statistical analysis of the surfaces of the fabrics of FIGS. 5 through 8, quantifying the degree of nap (or the relative ratio of disordered to ordered fibers) before and after multiple launderings.
Figure 10B:
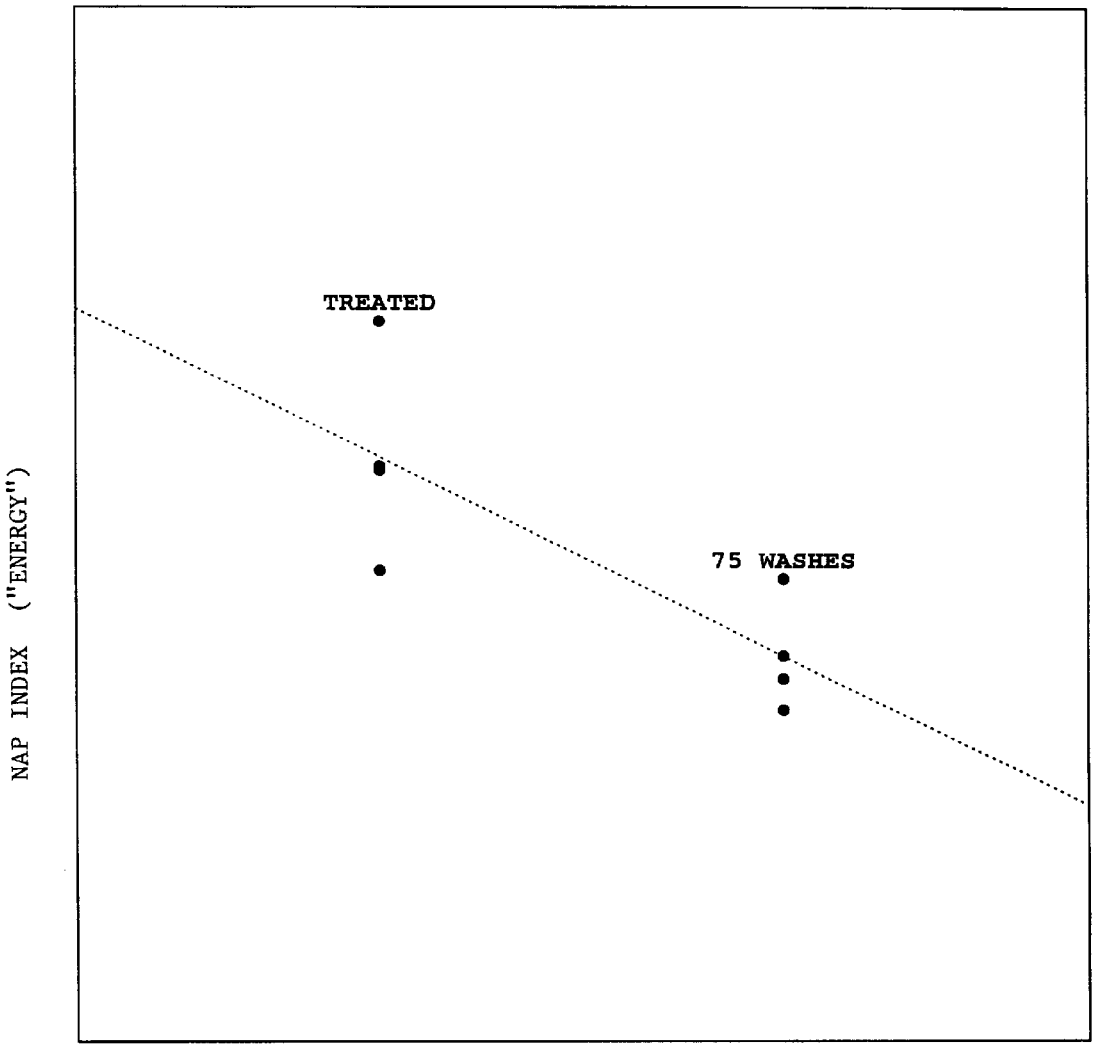
Figure 10C:
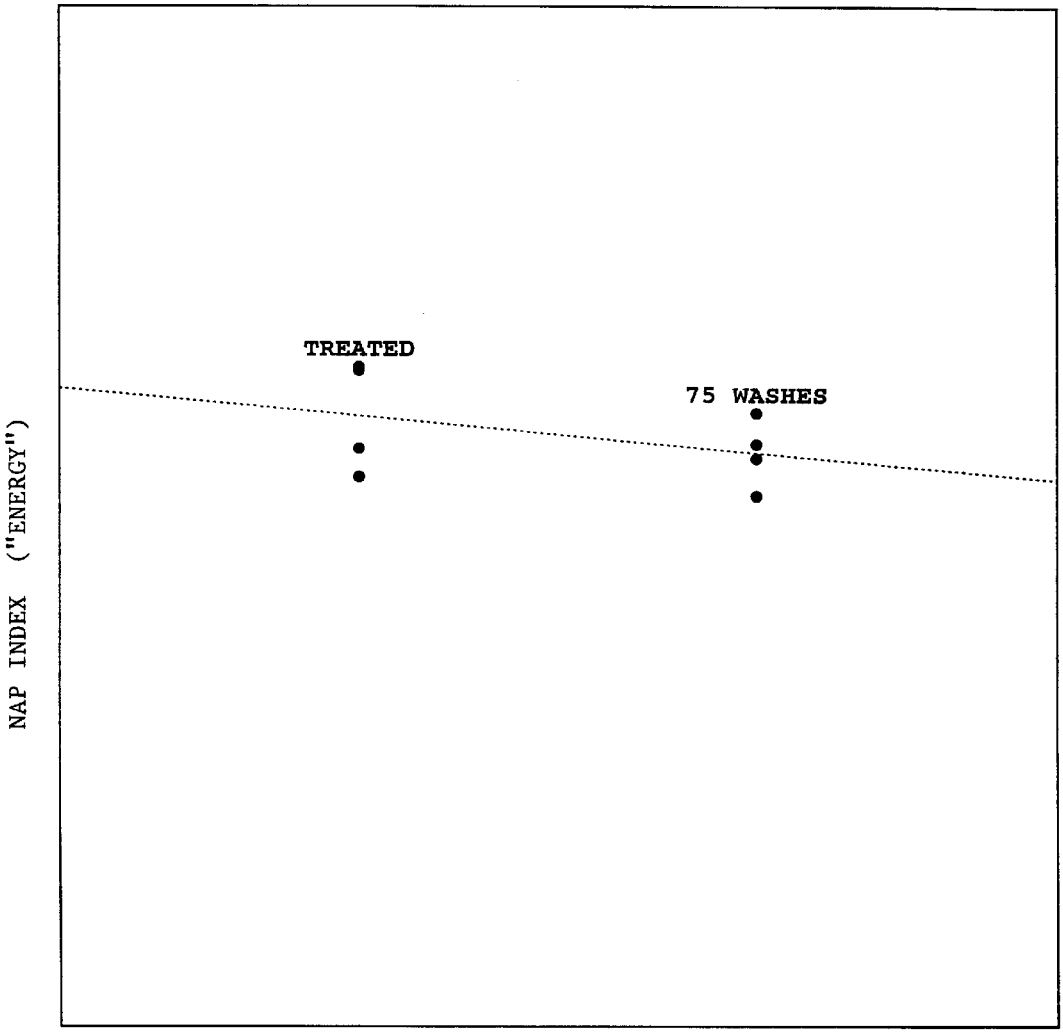

The results of the measurements are graphically depicted in FIGS. 10A through 10C. These results are fully consistent with subjective assessments made from visual examination of the photomicrographs, and are believed to support several conclusions. The subject fabric shows significant nap following one wash. The degree of nap is substantially increased after 75 washes, with a high degree of statistical confidence. This effect is totally absent from the results involving the first and second competitive fabric. The first competitive fabric shows, with a high degree of statistical confidence, a dramatic reduction in the degree of nap following 75 washes. The second competitive fabric shows, at best, no statistically significant increase in the degree of nap following 75 washes. For a more thorough discussion of this technique, see one or more of the following References: (1) Robert M. Haralick, K. Shanmugam, Its'hak Dinstein, "Textural Features for Image Classification," *IEEE Trans. Syst., Man, Cybernn.*, Vol. SMC-3, No. 6 (1973), 610–621; (2) Robert M. Haralick, "Statistical and Structural Approaches to Texture," Proc. IEEE, Vol. 67, No. 5 (1979), 786–804; (3) Steven W. Zucker, Demetri Terzopoulos, "Finding Structure in Co-Occurrence"; (4) "Matrices for Texture Analysis," *Comput. Graph. Image Processing*, Vol. 12 (1980), 286–308; (5) Anil K. Jain, "Fundamentals of Digital Image Processing," Prentice Hall (1989), 394–400.

In an effort to quantify further some of the aesthetic advantages of the instant invention, selected measurements were made using the Kawabata Evaluation System ("Kawabata System"). The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g., smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)

Kawabata Pure Bending Tester (KES FB2)

Kawabata Compression Tester (KES FB3)

Kawabata Surface Tester (KES FB4)

KES FB1 through 3 are manufactured by the Kato Iron Works Co., Ltd., Div. of Instrumentation, Kyoto, Japan. KES FB4 (Kawabata Surface Tester) is manufactured by the Kato Tekko Co., Ltd., Div. of Instrumentation, Kyoto, Japan. The results reported herein required only the use of KES FB 2 through 4.

The mechanical properties that have been associated with these aesthetic properties can be grouped into five basic categories for purposes of Kawabata analysis: bending properties, surface properties (friction and roughness), compression properties, shearing properties, and tensile properties. Each of these categories, in turn, is comprised of a group of related properties that can be separately measured. For the testing described herein, only parameters relating to the properties of surface, compression, and bending were used, as indicated in Table 2, below.

TABLE 2

KAWABATA PARAMETERS AND UNITS

| Kawabata Test Group | Kawabata Property and Definition | Property Units |
|---|---|---|
| Bending | 2HB = Moment of Hysteresis per unit length at 0.5 cm–1 (is the opposite of recovery) | Gms (force) cm/cm |
| Surface | MIU = Coefficient of friction | Dimensionless |
| Compression | LC = Linearity (ease of compressional deformation; similar to compressional modulus) | Dimensionless |
| | $DEN_{50}$ = Density in $g/cm^3$ based on thickness at 50 $gf/cm^2$ | Grams (force)/ $cm^3$ |
| | COMP = Percent compressibility based on difference in thickness divided by low pressure thickness | Percent |

The complete Kawabata Evaluation System is installed and is available for fabric evaluations at several locations throughout the world, including the following institutions in the U.S.A.:

North Carolina State University
College of Textiles
Dep't. of Textile Engineering Chemistry and Science
Centennial Campus
Raleigh, N.C.
Georgia Institute of Technology
School of Textile and Fiber Engineering
Atlanta, Ga.
The Philadelphia College of Textiles and Science
School of Textiles and Materials Science
Schoolhouse Lane and Henry Avenue
Philadelphia, Pa. 19144

Additional sites worldwide include The Textile Technology Center (Sainte-Hyacinthe, QC, Canada); The Swedish Institute for Fiber and Polymer Research (Mölndal, Sweden); and the University of Manchester Institute of Science and Technology (Manchester, England).

The Kawabata Evaluation System installed at the Textile Testing Laboratory at the Milliken Research Corporation, Spartanburg, S.C. was used as a means to quantify some of the characteristics of the invention disclosed herein, and compare those characteristics with those of the first and second competing fabrics, as well as a cotton fabric representative of fabrics commonly used in napery applications.

In each case, Kawabata testing was done following one industrial wash. The following fabrics were tested:

| | |
|---|---|
| First and Second Competitive Fabrics: | As described in Examples 2 and 3, respectively. |
| 100% Cotton Fabric: | A commercially available napery fabric having 74 ends and 58 picks and a weight of 5.5 ounces per square yard |
| Subject Fabrics 1–3: | 100% polyester spun warp napery fabrics having weights between 6.0 and 7.0 ounces and various constructions, following hydraulic napping in accordance with the teachings herein. |
| Subject Fabrics 4 and 5: | Two examples of the fabrics of Example 1, following hydraulic napping in accordance with the teachings herein. |

KAWABATA COMPRESSION TEST PROCEDURE

An 8 inch×8 inch sample was cut from the web of fabric to be tested. Care was taken to avoid folding, wrinkling, stressing, or otherwise handling the sample in a way that would deform the sample. The die used to cut the sample was aligned with the yarns in the fabric to improve the accuracy of the measurements. Multiple samples of each type of fabric were tested to improve the accuracy of the data.

The testing equipment was set-up according to the instructions in the Kawabata Manual. The Kawabata Compression Tester (KES FB3) was allowed to warm-up for at least 15 minutes before use. The gap interval was set according to the instructions in the Manual. Each sample was placed in the Compression Tester, and the plunger was lowered. The data was automatically recorded on an XY plotter. The values of LC, DEN50, and COMP were extracted and averaged. The results are as indicated in Table 3.

KAWABATA SURFACE TEST PROCEDURE

An 8-inch×8-inch sample was cut from the web of fabric to be tested. Care was taken to avoid folding, wrinkling, stressing, or otherwise handling the sample in a way that would deform the sample. The die used to cut the sample was aligned with the yarns in the fabric to improve the accuracy of the measurements. Multiple samples of each type of fabric were tested to improve the accuracy of the data.

The testing equipment was set-up according to the instructions in the Kawabata Manual. The Kawabata Surface Tester (KES FB4) was allowed to warm-up for at least 15 minutes before use. The proper weight was selected for testing the samples. The samples were placed in the Tester and locked in place. Each sample was tested for friction, and the data was printed as well as plotted on an XY recorder. The values of MIU were determined from the printed data and averaged. The results are as indicated in Table 3.

KAWABATA BENDING TEST PROCEDURE

An 8 inch×8 inch sample was cut from the web of fabric to be tested. Care was taken to avoid folding, wrinkling, stressing, or otherwise handling the sample in a way that would deform the sample. The die used to cut the sample was aligned with the yarns in the fabric to improve the accuracy of the measurements. Multiple samples of each type of fabric were tested to improve the accuracy of the data.

The testing equipment was set-up according to the instructions in the Kawabata Manual. The machine was allowed to warm-up for at least 15 minutes before samples were tested. The amplifier sensitivity was calibrated and zeroed as indicated in the Manual. The sample was mounted in the Kawabata Pure Bending Tester (KES FB2) so that the cloth showed some resistance but was not too tight. The fabric was tested in both the warp and fill directions, and the data was automatically recorded on an XY plotter. The value of 2HB for each sample was extracted from the chart and averaged. The results are as indicated in Table 3.

A table summarizing selected results of the KAWABATA testing is given below:

TABLE 3

| | KAWABATA RESULTS | | | | |
|---|---|---|---|---|---|
| Description | LC (Compression) | DEN 50 (Compression) | COMP (Compression) | MIU (Friction) | 2HB (Bending) |
| First competitive fabric | 0.316 | 0.473 | 36.63 | 0.178 | 0.160 |
| Second competitive fabric | 0.251 | 0.498 | 40.20 | 0.179 | 0.229 |
| 100% Cotton | 0.304 | 0.400 | 42.29 | 0.181 | 0.147 |
| Subject fabric (Sample 1) | 0.359 | 0.394 | 37.49 | 0.185 | 0.190 |
| Subject fabric (Sample 2) | 0.375 | 0.443 | 34.88 | 0.204 | 0.178 |
| Subject fabric (Sample 3) | 0.387 | 0.407 | 33.10 | 0.200 | 0.171 |
| Subject fabric (Sample 4) | 0.425 | 0.375 | 46.27 | 0.226 | 0.106 |
| Subject fabric (Sample 5) | 0.437 | 0.370 | 45.21 | 0.219 | 0.094 |

As may be seen from the results of Table 3, the five subject fabrics of the instant invention, and particularly those indicated as "Sample 4" and "Sample 5," are indicated as being quantitatively superior in several aesthetically important ways to the other listed fabrics. Specifically, it has been determined that the uniqueness of the fabrics of this invention may be characterized in accordance with the following individual Kawabata parameter values as follows: LC values greater than 0.31, preferably greater than 0.375, more preferably greater than 0.390, and most preferably greater than 0.410; $DEN_{50}$ values less than 0.400, and preferably less than 0.390, and most preferably less than 0.380; MIU values greater than 0.195, and preferably greater than 0.200, and most preferably greater than 0.215; COMP values greater than 42.5, and preferably greater than 44.0, and most preferably greater than 45.0; and, lastly, 2HB values that are less than 0.200, and preferably less than 0.140, more preferably less than 0.130, and most preferably less than 0.120. It should be understood that, because of the tendency for some properties of the fabrics of this invention to be mutually exclusive, the fabrics of this invention are not always characterized by values of any single Kawabata measurement, but rather by the combination of values of two or more Kawabata measurements.

Having described the principles of my invention in the form of the foregoing exemplary embodiments and non-limiting Examples, it should be understood by those skilled in the art that the invention can be modified in arrangement and detail without departing from such principles, and that all such modifications falling within the spirit and scope of the following claims are intended to be protected hereunder.

We claim:

1. A process for forming a napped fabric wherein said fabric passes through a treatment zone in which a plurality of individual streams of high pressure fluid is directed onto said fabric, said process comprising the steps of (a) directing said fabric against a support member having a support surface as said fabric enters said treatment zone, (b) directing said fabric away from said support surface as said fabric moves through said treatment zone, and (c) directing said plurality of individual streams onto said fabric as said fabric is leaving said treatment zone and is moving away from said support surface, thereby forming on said fabric a napped surface, said surface being adjacent to said support surface.

2. A process for forming a napped surface on both a first and a second side of a woven fabric, said fabric being comprised of yarns containing staple fibers, said process comprising the steps of moving said fabric along a path in which said fabric passes through a first treatment zone wherein a plurality of individual streams of high pressure fluid is directed onto said first side of said fabric, whereby said fluid streams arrange said staple fibers to form a napped surface comprised of fiber tangles on said second side of said fabric, and then moving said fabric along said path wherein said fabric passes through a second treatment zone wherein a plurality of individual streams of high pressure fluid is directed onto said second side of said fabric, whereby said fluid streams partially redistribute said fiber tangles from said second side of said fabric to said first side of said fabric, wherein said fluid streams in said second treatment zone directed at said second side have a pressure that is substantially less than the pressure of said fluid streams in said first treatment zone directed at said first side.

3. The process of claim 2 wherein the pressure of said fluid streams in said second treatment zone is less than the pressure of said fluid jets in said first treatment zone by a factor that is greater than about 0.2 and less than about 0.8.

4. The process of claim 2 wherein the pressure of said fluid streams in said second treatment zone is less than the pressure of said fluid streams in said first treatment zone by a factor that is greater than about 0.4 and less than about 0.6.

5. The process of claim 2 wherein said path directs said fabric against a support member having a support surface as said fabric enters one of said treatment zones, and then directs said fabric away from said support surface within said one of said treatment zones.

6. The process of claim 2 wherein said path directs said fabric against a support member having a support surface as said fabric enters each of said treatment zones, and then directs said fabric away from said support surface within said each of said treatment zones.

7. The process of claim 2 wherein said napped surface formed by said fiber tangles is substantially uniform on both said first side and said second side.

* * * * *

UNITED STATES PATENT AND TRADEMARK OFFICE

CERTIFICATE OF CORRECTION

PATENT NO. : 6,546,605 B1
DATED : April 15, 2003
INVENTOR(S) : Emery et al.

It is certified that error appears in the above-identified patent and that said Letters Patent is hereby corrected as shown below:

Title page,
Item [22], please delete "Jul. 10, 2001" and insert -- June 25, 1999 --.

Signed and Sealed this

Eighth Day of June, 2004

JON W. DUDAS
*Acting Director of the United States Patent and Trademark Office*